US010123601B1

(12) United States Patent
Tong

(10) Patent No.: US 10,123,601 B1
(45) Date of Patent: Nov. 13, 2018

(54) LAPTOP BAG INCORPORATED LUGGAGE

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 0 days.

(21) Appl. No.: 15/896,076

(22) Filed: Feb. 14, 2018

(51) Int. Cl.

| | |
|---|---|
| ***A45C 5/14*** | (2006.01) |
| ***A45C 13/02*** | (2006.01) |
| ***A45C 13/26*** | (2006.01) |
| ***A45C 13/10*** | (2006.01) |
| ***A45C 5/03*** | (2006.01) |

(52) U.S. Cl.
CPC ..... *A45C 13/02* (2013.01); *A45C 5/03* (2013.01); *A45C 5/14* (2013.01); *A45C 13/103* (2013.01); *A45C 13/1092* (2013.01); *A45C 13/262* (2013.01); *A45C 2013/025* (2013.01); *A45C 2013/267* (2013.01)

(58) Field of Classification Search
CPC ... A45C 5/14; A45C 11/003; A45C 2013/003; A45C 13/02; A45C 2013/025; A45C 5/03
USPC ..... 190/39, 902
See application file for complete search history.

(56) References Cited

U.S. PATENT DOCUMENTS

| | | | | |
|---|---|---|---|---|
| 6,098,769 | A * | 8/2000 | Yen | A45C 5/14 190/102 |
| 6,467,594 | B1 * | 10/2002 | Wu | A45C 7/0045 150/107 |
| 6,745,877 | B1 * | 6/2004 | Tsai | A45C 5/14 190/115 |
| 9,174,077 | B2 * | 11/2015 | Lim | A62C 35/68 |
| 2009/0223765 | A1 * | 9/2009 | Bosma | A45C 7/0045 190/108 |
| 2009/0229936 | A1 * | 9/2009 | Cuong | A45C 3/02 190/107 |
| 2009/0314594 | A1 * | 12/2009 | Harrison | A45C 3/02 190/109 |
| 2011/0155526 | A1 * | 6/2011 | Cheng | A45C 5/14 190/18 A |
| 2012/0273314 | A1 * | 11/2012 | Raymond | A45C 5/14 190/18 A |
| 2017/0020250 | A1 * | 1/2017 | Boschan | A45C 5/06 |

* cited by examiner

*Primary Examiner* — Sue A Weaver
(74) *Attorney, Agent, or Firm* — Pai Patent & Trademark Law Firm; Chao-Chang David Pai

(57) ABSTRACT

A laptop bag incorporated luggage includes a boarding bag, a flexible cloth cover connected to the top panel of the boarding bag, a laptop bag provided at the inner side of the flexible cloth cover for holding a laptop and turnable with the flexible cloth cover to cover or open the front panel of the boarding bag. Thus, the laptop bag and the boarding bag can be quickly extended out to pass the customs' X-ray inspection, facilitating the user to take or put into the laptop.

6 Claims, 6 Drawing Sheets

LAPTOP BAG INCORPORATED LUGGAGE

BACKGROUND OF THE INVENTION

(a) Field of the Invention

The present invention relates to luggage technology and more particularly, to a laptop bag incorporated luggage, which comprises a laptop bag hung on a front panel of a boarding bag thereof for storing a notebook computer to facilitate X-ray inspection in the customs.

(b) Description of the Prior Art

Conventional boarding bags are commonly about 17" to 20" in size, facilitating users to bring them to the aircraft seat so that they can carry a valuable and readily available item at all times, such as notebook computer or tablet computer. However, conventional boarding bags are designed for the user to accommodate a notebook computer or tablet computer in a storage chamber therein or a packet in the front panel, but not allow the user to hang a notebook computer or tablet computer on the outside. So, when the user travels along, it is quite inconvenient to take the storage laptop from the boarding bag or to put the laptop in the boarding bag. When going to take or store the laptop, the user needs to open the zip fastener of the front or top cover of the boarding bag.

In particular, inspections by airports and seaports in various countries nowadays are becoming more and more stringent. Usually, when carrying a notebook computer in the boarding bag, the laptop must be taken out of the boarding bag for separate inspection through the customs' X-ray inspection machine. Therefore, before and after passing through the customs, one needs to open the entire boarding bag to take and put into a laptop. This procedure is quite inconvenient. When opening the boarding bag to take out the storage laptop, other items within the boarding bag are easily revealed to others. The protection of personal privacy is not comprehensive enough. Therefore, luggage specifically designed for carrying laptop are created. U.S. Pat. No. 7,975,816 discloses a bag to accommodate and to carry a notebook computer. This design of bag includes a pull-rod computer bag and a housing cover with a computer hold tank. According to this design, the pull-rod computer bag and a housing cover cannot be extended out for passing through the inspection of the customs.

SUMMARY OF THE INVENTION

The present invention has been accomplished under the circumstances in view. It is one object of the present invention to provide a laptop bag incorporated luggage, which comprises a boarding bag, a flexible cloth cover stitched to the boarding bag and adapted for shielding the front panel of the boarding bag, a laptop bag joined to an inner side of the flexible cloth cover for storing a notebook computer and turnable with the flexible cloth cover away from the front panel of the boarding bag to facilitate passing X-ray inspection in the customs.

It is another object of the present invention to provide a laptop bag incorporated luggage, which uses a detachable connection unit to connect the flexible cloth cover and the boarding bag, facilitating quick separation and connection between the laptop bag and the boarding bag.

Other advantages and features of the present invention will be fully understood by reference to the following specification in junction with the accompanying drawings, in which like reference signs denote like components of structure.

DETAILED DESCRIPTION OF THE PREFERRED EMBODIMENTS

Figure 1:
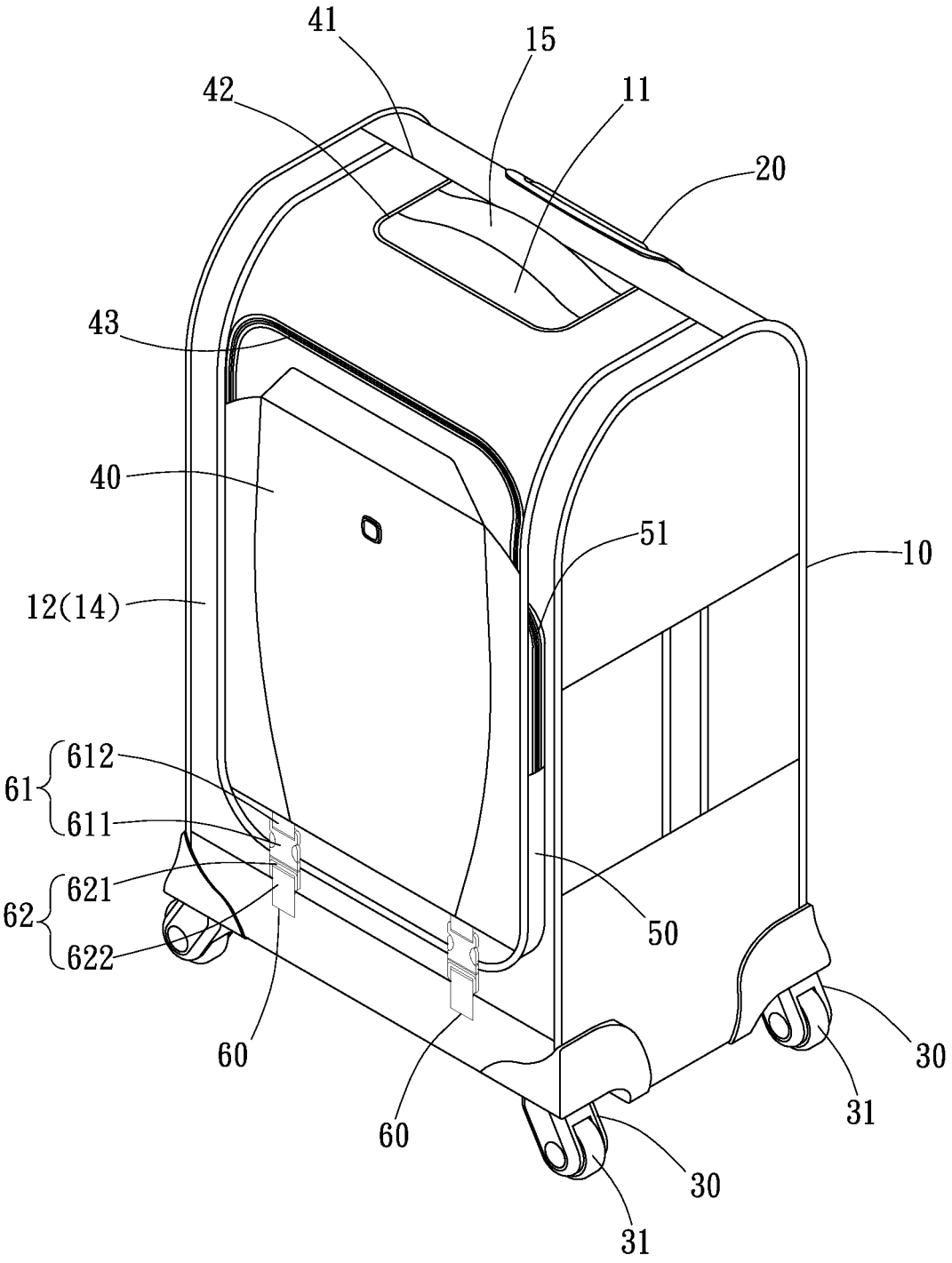
FIG. 1 is an oblique top elevational view of a laptop bag incorporated luggage in accordance with the present invention.
Figure 3:
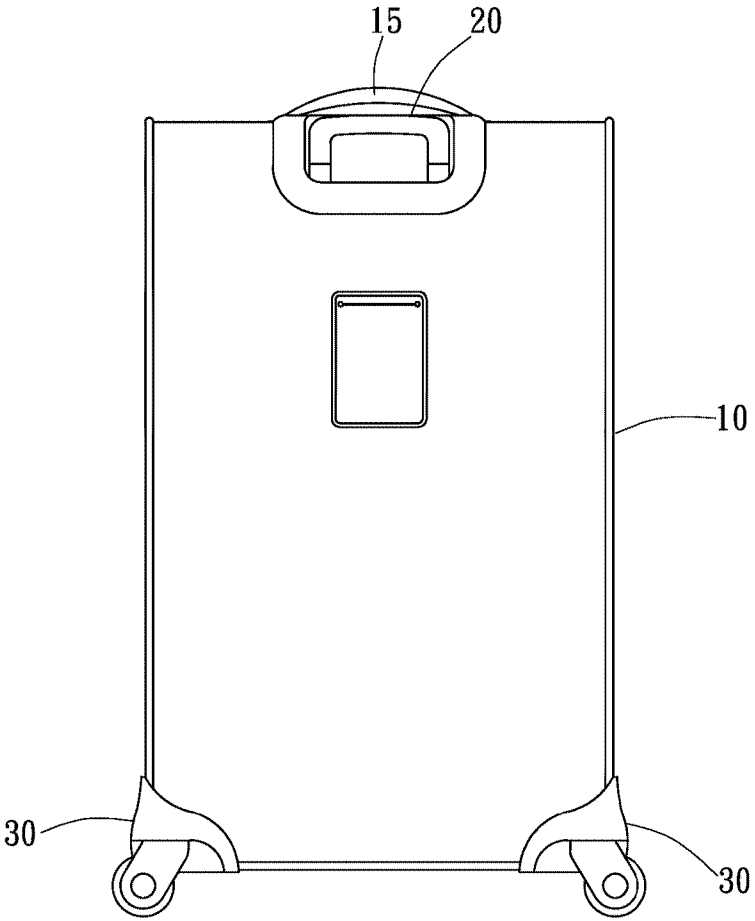
FIG. 3 is a schematic rear side view of the laptop bag incorporated luggage in accordance with the present invention.
Figure 2:
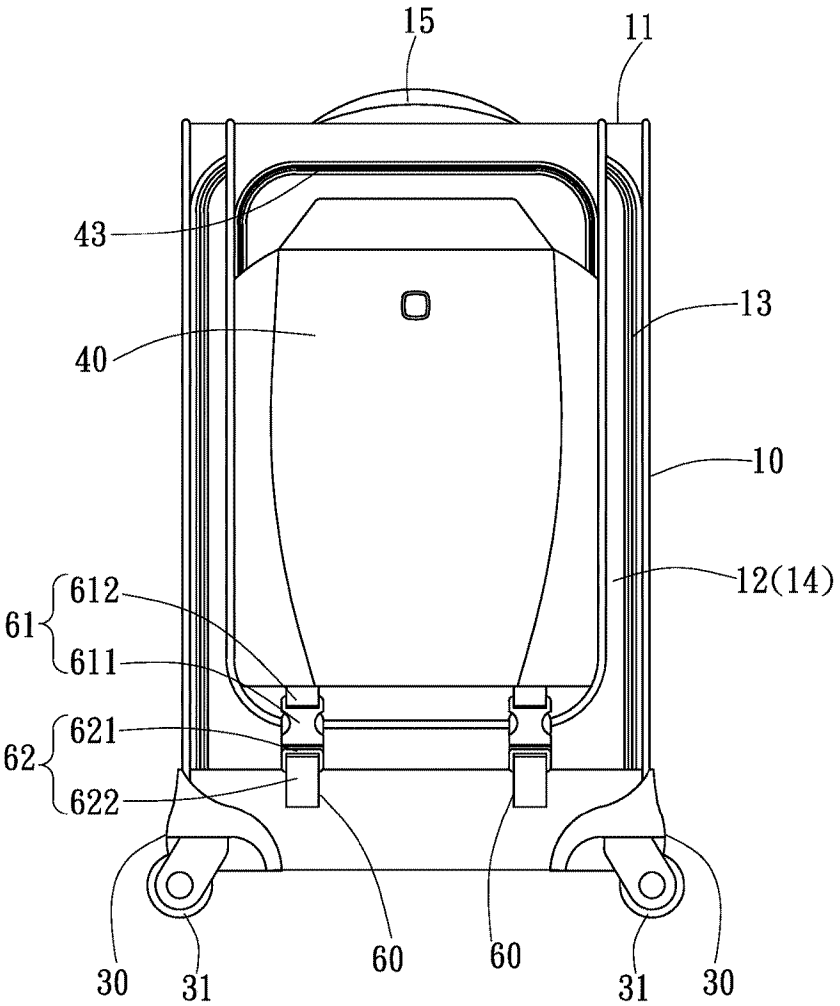
FIG. 2 is a schematic front view of the laptop bag incorporated luggage in accordance with the present invention.
Figure 5:
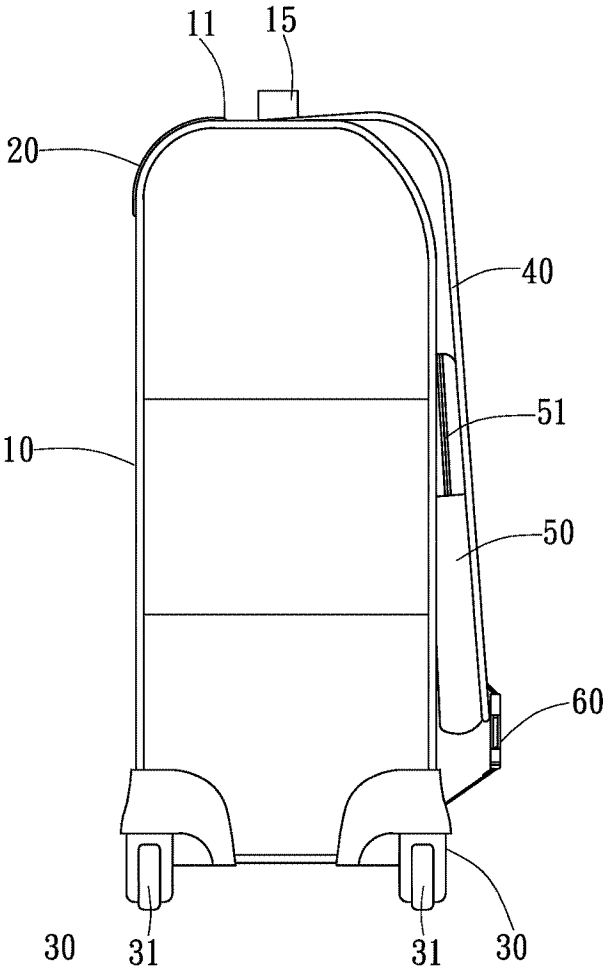
FIG. 5 is a schematic left side view of the laptop bag incorporated luggage in accordance with the present invention.
Figure 4:
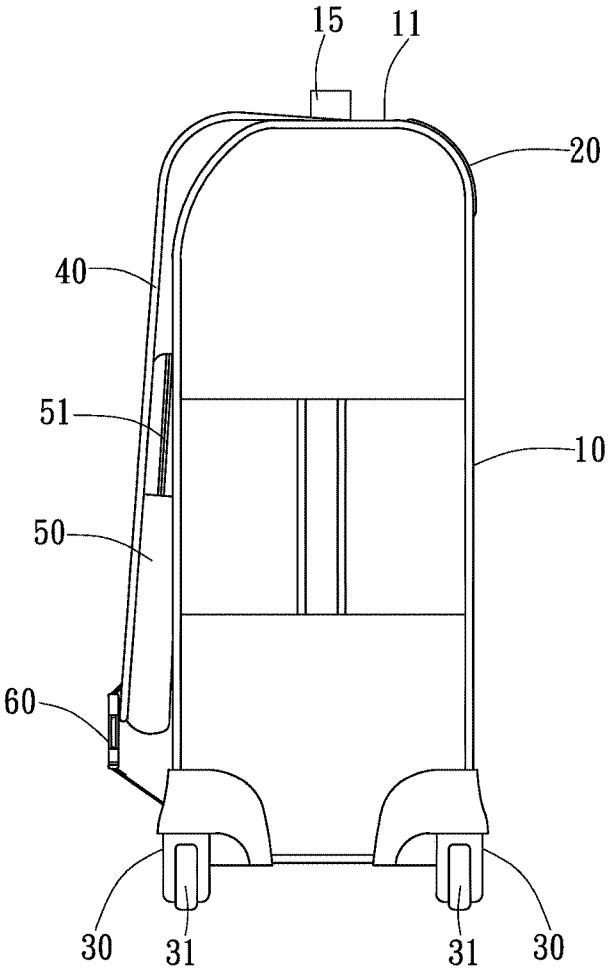
FIG. 4 is a schematic right-side view of the laptop bag incorporated luggage in accordance with the present invention.
Figure 6:
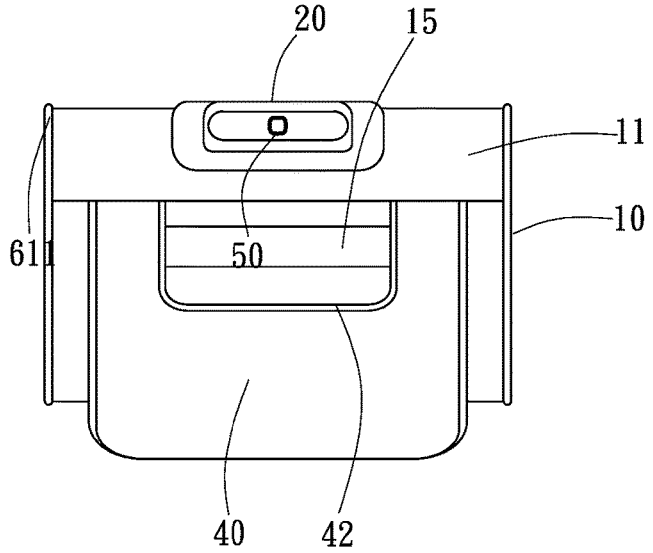
FIG. 6 is a schematic top view of the laptop bag incorporated luggage in accordance with the present invention.

Referring to FIGS. 1, 2 and 6, a laptop bag incorporated luggage in accordance with the present invention is shown. The laptop bag incorporated luggage comprises a rectangular boarding bag 10 made of a soft cloth by stitching, a retractable handle assembly 20 mounted in a top panel 11 of the boarding bag 10 and embedded inside the boarding bag 10, and a plurality of roller assemblies 30 mounted to a bottom side of the boarding bag 10.

Figure 7:
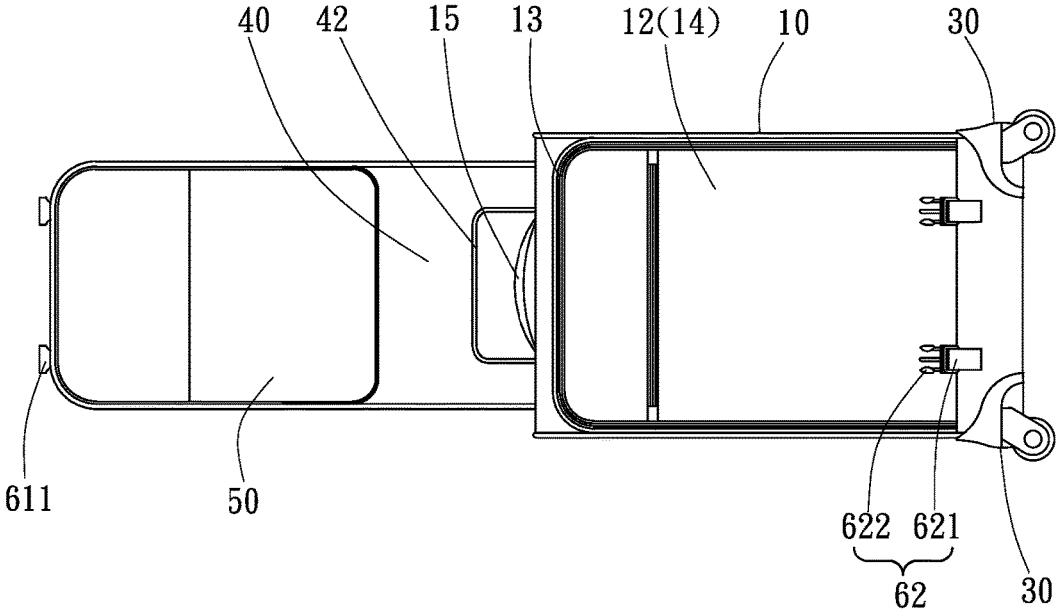
FIG. 7 is a schematic applied view of the present invention, illustrating the flexible cloth cover and the laptop bag opened.
Figure 8:
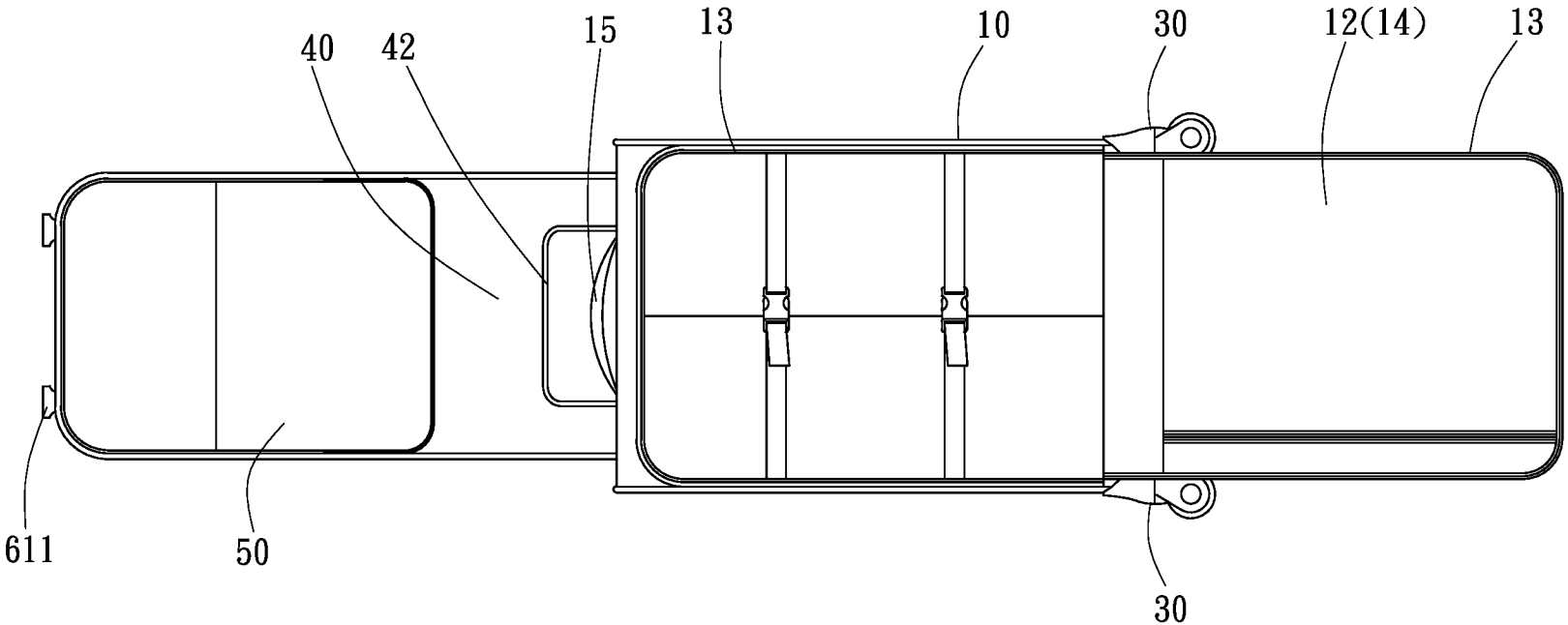
FIG. 8 is a schematic applied view of the present invention, illustrating the front cover of the boarding bag extended out.

Each roller assembly 30 comprises a roller 31. The boarding bag 10 comprises a first zipper opening 13 located on a front panel 12 thereof and disposed in communication with a storage chamber in the boarding bag, thereby creating an openable front cover 14 (see FIG. 7 and FIG. 8). The laptop bag incorporated luggage further comprises a flexible cloth cover 40, and a laptop bag 50 joined to the flexible cloth cover 40. The flexible cloth cover 40 is this embodiment is a rectangular sheet, having a top edge 41 stitched to a top edge of the top panel 11 or front panel 12 of the boarding bag 10, thus, the flexible cloth cover 40 can be turned forward to shield the front panel 12 of the boarding bag 10, or lifted upward to open the front panel 12 of the boarding bag 10. The laptop bag 50 can be turned with the flexible cloth cover 40 upwardly away from the front panel 12 of the boarding bag 10, and can also be turned with the flexible cloth cover 40 in the reversed direction to shield the front panel 12 of the boarding bag 10

Referring to FIGS. 1 and 2 again, the laptop bag incorporated luggage further comprises a detachable connection unit 60. The detachable connection unit 60 is connected between an opposing bottom edge of the flexible cloth cover 40 and the front panel 12 of the boarding bag 10. Preferably, the detachable connection unit 60 comprises a first buckle 61 fastened to the flexible cloth cover 40, and a second buckle 62 fastened to the boarding bag 10. The first buckle 61 is detachably connectable with the second buckle 62. Preferably, the first buckle 61 comprises a female buckle member 611, and a belt 612 connected between the female buckle member 611 and the flexible cloth cover 40; the second buckle 62 comprises a male buckle member 621, and a belt 622 connected between the male buckle member 621 and the boarding bag 10. By means of the design of the detachable connection unit 60, the flexible cloth cover 40 and the laptop bag 50 can be locked to the front panel 12 of the boarding bag 10. When going to open the laptop bag 50 or taken out the laptop, unfasten the first buckle 61 and the second buckle 62, allowing the laptop bag 50 to be turned with the flexible cloth cover 40 upwardly away from the front panel 12 of the boarding bag 10.

Referring to FIGS. 1 and 2 again, the boarding bag 10 further comprises an arched carrying handle 15 mounted at the top panel 11. Preferably, the top edge 41 of the flexible cloth cover 40 is stitched to the top panel 11 of the boarding bag 10. In this case, the flexible cloth cover 40 is configured to provide a handle opening 42 for the passing of the arched carrying handle 15 to the outside of the flexible cloth cover 40. Further, the flexible cloth cover 40 comprises a front zipper opening 43 disposed in communication with a secret compartment (not shown) in the flexible cloth cover 40. Through the front zipper opening 43, the user can access to the secret compartment for storing small items or taking out small storage items. The laptop bag 50 comprises a side zipper opening 51 located on one side thereof and disposed in communication with a laptop storage chamber (not shown) in the laptop bag 50 for storing a notebook computer or tablet computer.

Figure 9:
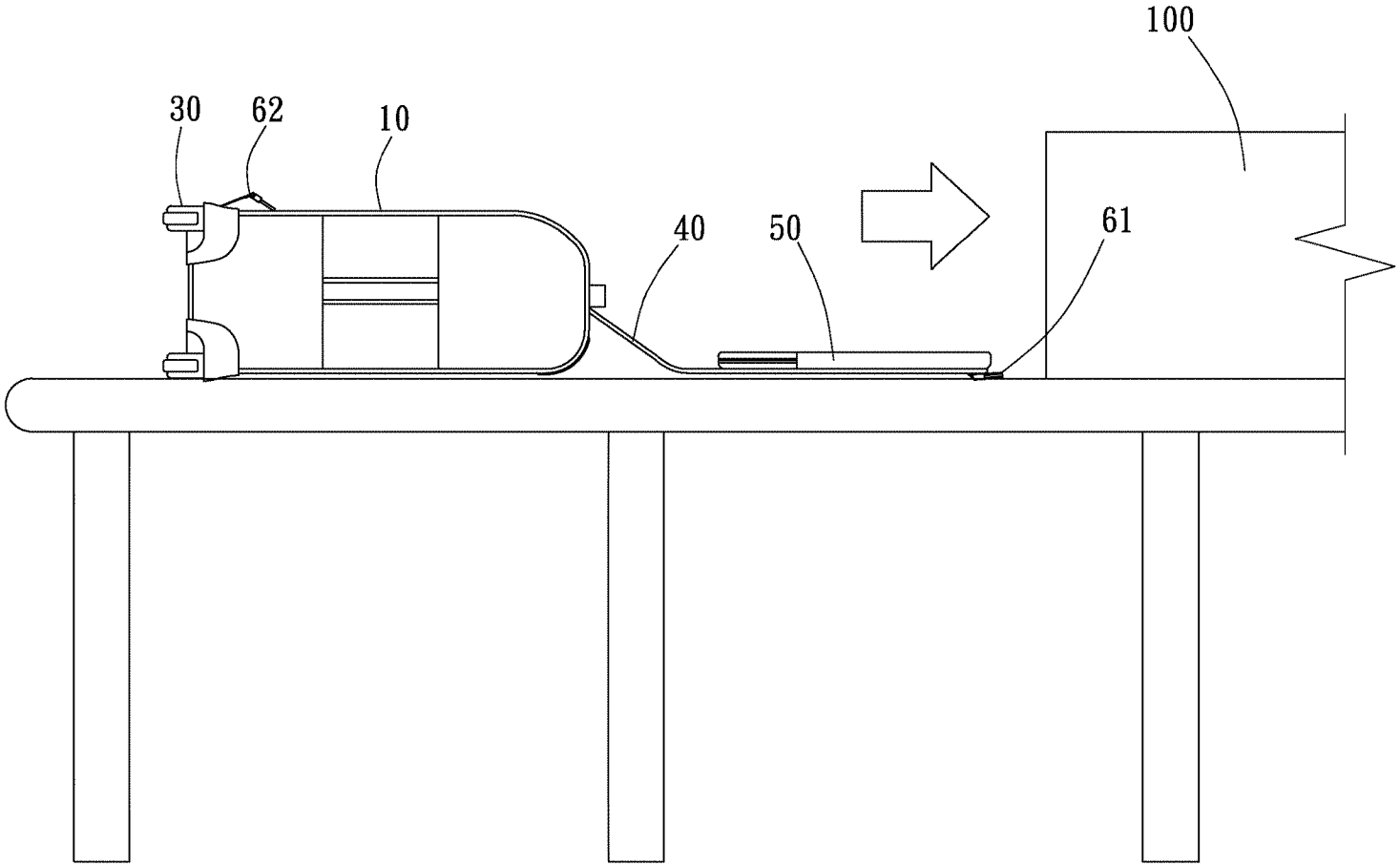
FIG. 9 is a schematic applied view of the present invention, illustrating the laptop bag incorporated luggage and the laptop bag extended out and passed the X-ray inspection.

Referring to FIG. 9, by means of the flexible cloth cover 40, the laptop bag incorporated luggage enables the laptop bag 50 to be hung on the front panel of the boarding bag 10, allowing the user to store a notebook in the laptop bag 50. If you need to pass the customs, you can unfasten the detachable connection unit 60, and then open the flexible cloth cover 40 and the laptop bag 50, enabling the boarding bag 10 and the laptop bag 50 to be separately lied on the X-ray machine 100 for inspection. After inspection, use the detachable connection unit 60 to fasten the flexible cloth cover 40 and the laptop bag 50 to the front panel of the boarding bag 10 again. Therefore, the present invention can improve the problem of the use of a conventional luggage in carrying a notebook computer to pass through the customs, making the user more convenient and quick to pass inspection.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A laptop bag incorporated luggage, comprising:

a boarding bag made of a soft cloth by stitching, comprising a top panel, a retractable handle assembly mounted in said top panel and embedded inside said boarding bag, an arched carrying handle located at said top panel, and a plurality of roller assemblies mounted to a bottom side of said boarding bag, each of said plurality of roller assemblies comprising a roller;

a flexible cloth cover having a top edge thereof selectively connected to a top edge of said top panel or front panel of said boarding bag so that said flexible cloth cover is capable of being covered over said front panel of said boarding bag or turned upward to open said front panel of said boarding bag; and a laptop bag joined to an inner side of said flexible cloth cover, said laptop bag being turnable upwardly with said flexible cloth cover to open said front panel of said boarding bag or turnable downwardly with said flexible cloth cover to shield said front panel of said boarding bag, wherein said top edge of said flexible cloth cover is connected to said top panel of said boarding bag; and said flexible cloth cover comprises a handle opening for said arched carrying handle of said boarding bag to pass to the outside of said flexible cloth cover.

2. The laptop bag incorporated luggage as claimed in claim 1, further comprising a detachable connection unit detachably connected between said flexible cloth cover and said boarding bag.

3. The laptop bag incorporated luggage as claimed in claim 2, wherein said detachable connection unit comprises a first buckle mounted at said flexible cloth cover, and a second buckle mounted at said boarding bag and detachably connectable with said first buckle.

4. The laptop bag incorporated luggage as claimed in claim 3, wherein said first buckle comprises a female buckle member, and a belt connected between said female buckle member and said flexible cloth cover; said second buckle comprises a male buckle member, and a belt connected between said male buckle member and said boarding bag.

5. The laptop bag incorporated luggage as claimed in claim 1, wherein said flexible cloth cover comprises a front zipper opening disposed in communication with a secret compartment in said flexible cloth cover.

6. The laptop bag incorporated luggage as claimed in claim 1, wherein said laptop bag comprises a side zipper opening located on one side thereof and disposed in communication with a storage chamber in said laptop bag.

* * * * *